United States Patent [19]

Slot

[11] Patent Number: 5,012,729

[45] Date of Patent: May 7, 1991

[54] DEVICE FOR WORKING PLATE-SHAPED MATERIAL

[75] Inventor: Teunis Slot, Laren, Netherlands

[73] Assignee: Safan B. V., Lochem, Netherlands

[21] Appl. No.: 483,032

[22] Filed: Feb. 16, 1990

[30] Foreign Application Priority Data

Feb. 22, 1989 [NL] Netherlands ..... 8900429

[51] Int. Cl.[5] ..... B30B 5/00; B30B 1/00

[52] U.S. Cl. ..... 100/278; 72/389; 72/429; 100/53; 100/231; 100/267

[58] Field of Search ..... 100/231, 278, 265–268, 100/53, 258 R, 258 A, 46, 259; 72/429, 389, 456, 445, 440, 434

[56] References Cited

U.S. PATENT DOCUMENTS

| | | | |
|---|---|---|---|
| 2,351,824 | 6/1944 | Le Tourneau | 100/278 |
| 2,370,739 | 3/1945 | le Tourneau | 100/278 X |
| 4,608,922 | 9/1986 | Pohl | 100/278 X |

FOREIGN PATENT DOCUMENTS

| | | | |
|---|---|---|---|
| 407574 | 12/1924 | Fed. Rep. of Germany | 100/278 |
| 3419123 | 11/1985 | Fed. Rep. of Germany . | |
| 709382 | 1/1980 | U.S.S.R. | 100/278 |
| 740525 | 6/1980 | U.S.S.R. | 100/278 |
| 512521 | 9/1939 | United Kingdom | 72/389 |
| 1028868 | 5/1966 | United Kingdom . | |

*Primary Examiner*—Harvey C. Hornsby
*Assistant Examiner*—Stephen F. Gerrity
*Attorney, Agent, or Firm*—Ladas & Parry

[57] ABSTRACT

The invention relates to a device for working plate-shaped material, the device being provided with a frame and a pair of cooperating elongated working members. One of these working members has a stationary arrangement in the frame, while the other is movable in the frame, transversely to its longitudinal direction, towards and away from the stationary working member. Both the frame and the movable member are each provided with a plurality of rollers which, when seen in the longitudinal direction of the working members, are arranged one behind the other. An endless belt is passed over the series of rollers. The belt is fixed at one end and is at it other end connected with a driving means, by which the belt can be moved in its longitudinal direction to draw the movable member and frame closer together, or to permit them to move apart under the influence of an external opposing force.

12 Claims, 2 Drawing Sheets

DEVICE FOR WORKING PLATE-SHAPED MATERIAL

BACKGROUND OF THE INVENTION

1. Field of the Invention

This invention relates to material handling apparatus, and more particularly to an apparatus for working plate-shaped material.

2. Description of the Prior Art

Apparatus of this type is typically provided with a frame and a pair of cooperating elongated working means, one of the working means having a stationary arrangement in the frame and the other being movable in the frame, transversely to its longitudinal direction, towards and away from the stationary working means. Such devices are e.g. known in the shape of press brakes and guillotine shears, whereby the elongated means are respectively formed by cooperating stamps, by means of which the plate to be worked can be folded, or deflected, in the desired manner or by co-operating knives by means of which the plate can be sheared. Usually the elongated working means, which is movable transversely to its longitudinal direction, is thereby mounted on a beam, whereby driving means, usually in the shape of hydraulic setting cylinders, act on both ends of the beam. Such a beam must have a particularly heavy construction in practice, in order to resist undesirable deformations as well as possible. Particularly with press brakes this is very important, because undesired deformations not only may have an adverse effect on the life of the working means, but also may lead to undesirable dimensional variations in the product formed.

From the British Patent Specification No. 1,028,868, there is known a press whereby a working means having a movable arrangement in the frame can be moved by means of an inflatable bag extending along the length of the working means. Such a flexible bag is vulnerable to damage, and the movement effected by means of such a bag is difficult to control accurately.

German Patent Application 3,419,123 illustrates the principle of a press wherein the two working means are movable by means of a cable wound on the two working means. One of the disadvantages of this known construction is the poor accessibility of the space between the working means.

SUMMARY OF THE INVENTION

The object of the invention is to obtain a device of the above kind, wherein the above disadvantages of the known devices can be obviated.

According to the invention, this can be achieved in that the frame and the movable working means are each provided with a plurality of guide means which, when seen in the longitudinal direction of the working means, ar arranged one behind the other, while an endless flexible pulling means, for example a belt, is passed over the guide means, such that the belt extends from each guide means connected with the frame (or the movable means, as the case may be) towards, and is passed over, a pair of opposite guide means connected with the movable means (or with the frame, as the case may be), while the belt is fixed at one end and is at its other end connected with a driving means, by which the belt can be moved in its longitudinal direction.

By using the construction according to the invention, a construction can be obtained wherein the force required for moving the movable elongated working means can be transferred, distributed over the longitudinal direction of said working means, to the frame part supporting the movable working means, as a result of which undesired deformations can be avoided to a large extent.

According to a further aspect of the invention, use is made of electric brushless servo motors for driving the movable elongated working means. In this manner it becomes possible to control the large mechanical power required for moving the elongated working means during operation directly by electronic means. This provides a considerable simplification compared with the conventional constructions which use hydraulic drives whereby fluid must be pressurized by means of pumps driven by electromotors or the like and must be supplied to setting cylinders driving the elongated working means.

BRIEF DESCRIPTION OF THE DRAWING

The invention will be further explained hereinafter with reference to possible embodiments of the construction according to the invention diagrammatically illustrated in the accompanying figures.

DESCRIPTION OF THE PREFERRED EMBODIMENTS

Figure 1:
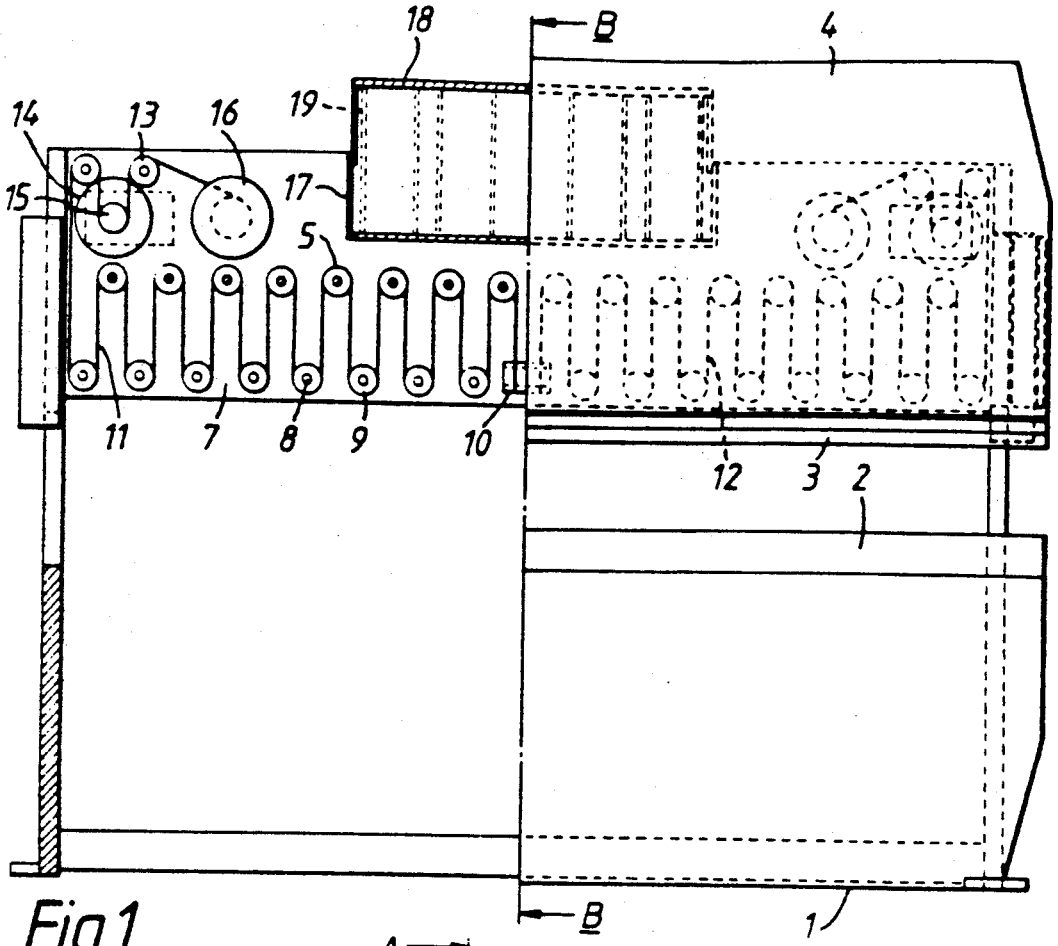
FIG. 1 shows an embodiment of the device according to the invention in the shape of a press brake, partly in elevational view and partly in section, along the line A—A in FIG. 2.

The press brake illustrated in FIG. 1 comprises a frame 1 with a lower beam 2 fixed thereto. The lower beam 2 cooperates with an upper beam 3 extending parallel thereto for folding plates or the like, said upper beam 3 being supported by a frame part 4 which can move up and down with respect to the frame 1. To the frame part 4 there are connected, a plurality of guide means in the shape of rolls 5, which are freely rotatable and arranged one behind the other when seen in the longitudinal direction of the upper beam 3, by means of shafts 6 being secured to the frame part 4 and extending horizontally and perpendicular to the longitudinal direction of the upper beam 3. From the Figure, it will be apparent that the central axes of the shafts 6 are located one behind the other and in a horizontal plane extending parallel to the upper beam 3, when seen in the longitudinal direction of the upper beam 3. The shafts 6 are thereby provided regularly spaced along the length of the frame part 4 supporting the upper beam 3. In a similar manner, a plurality of shafts 8, extending parallel to the shafts 6, are secured to a plate 7 extending parallel to the frame part 4, guide means formed by rolls 9 being freely rotatable about shafts 8. The rolls 5 and 9 are arranged in two groups, one group located on each side of an anchoring block 10 mounted near the center of the plate 7 and at the same level as the shafts 8. As will furthermore be apparent from FIG. 1, each roll 9 is located centrally between two rolls 5 located opposite roll 9, when seen in plan view.

To the anchoring block 10, there are secured the ends of a pair of flexible pulling means formed by belts 11 and 12. As is illustrated in FIG. 1, the pulling means are alternately passed over a roll 5 and a roll 9, respectively, in such a manner that two belt parts extend from a roll 5 or a roll 9, as the case may be, in the direction of rolls 9 and 5, respectively, which are arranged opposite thereto.

The end of each belt 11, 12 remote from the anchoring block 10 is passed, by means of a pair of guide rolls 13, over a driving pulley 15 mounted on the outgoing shaft of a motor 14. The free end of each belt is furthermore wound on a drum 16. Preferably, an electric, so-called brushless servo motor, is used for a driving motor.

To the frame plate 7, there is furthermore secured a casing part 17, in which a second casing part 18 secured to the frame part 4 can move up and down. The design of the casing parts 17 and in cooperation with the frame parts 7, 4 supporting the casing parts, is such that the casing parts 17 and 18 form a closed space. In the closed space, there are arranged a plurality of compression springs 19, which are supported with their bottom ends on the bottom of the casing part 17, and which abut with their upper ends against the upper wall of the casing part 18. It will be apparent that the arrangement is thereby such that the springs tend to press the casing part 18 with the frame part 4 secured thereto and the upper beam 3 upwards to a raised final position.

For moving the upper beam 3 downwards in order to effect cooperation of upper beam 3 with the lower beam 2 in the intended manner, e.g., for deflecting or folding a plate placed between the two beams 2 and 3, the two motors 14 can be put into operation, in such a manner that the belts 11 and 12 are wound on the drums 16. It will be apparent that the rolls 5 will thereby be pulled in the direction of the rolls 9 by means of the belts 11, 12, as a result of which the frame part 4 with the upper beam 3 supported by the frame part 4, will be moved downwards, when seen in the FIGS. 1 and 2, against the action of the springs 19. Because of the arrangement of the rolls 5, evenly distributed over the length of the frame part 4, the force exerted on the plate-shaped material to be worked will be evenly applied along the entire length of the upper beam 3, as a result of which undesirable deformations of upper beam 3 can be obviated to a large extent. When the force is released, or in case the belts 11 and 12 break, the springs 19 will always make sure that the frame part 4, with the upper beam 3 supported by said frame part 4, will be moved upwards, which constitutes an important safety feature, as this prevents the upper beam 3 from falling down in case of failure of the drive or the like.

As already said before, a very simple drive, which can be very well electronically controlled, can be utilized when use is made of an electric brushless servo motor. It will be apparent, however, that other driving means for moving the belts 11 may be used, both rotating driving motors and linear driving motors, e.g., setting cylinders.

Furthermore, it is also possible to use cables or chains, or similar endless means, instead of belts.

Furthermore, it is not necessary to make use of two belts 11 and 12 or the like, which are secured near the center of the upper beam 3 with their ends. Possibly, a single belt will do, such belt being fixed near one side of the device and being connected with a driving source near the other side of the device.

In the illustrated embodiment, a device has been shown wherein the upper elongated working means, or folding beam 3, is arranged to be vertically movable. It will be apparent that the invention can just as well be used with a device wherein the upper working means is stationary and wherein the lower working means can move up and down.

In such a case it is also possible not to use the springs 19, which will result in a very simple construction.

Figure 3:
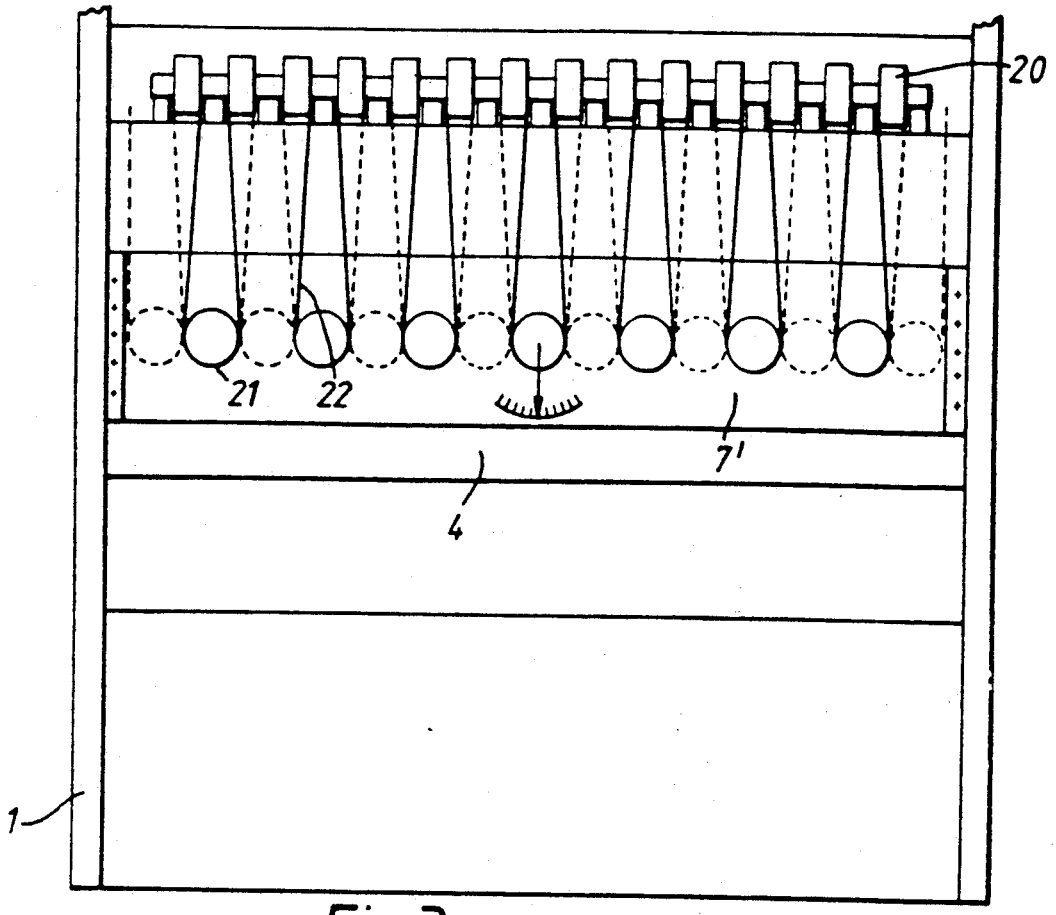
FIG. 3 shows an elevational view of a second possible embodiment of a device according to the invention.
Figure 4:
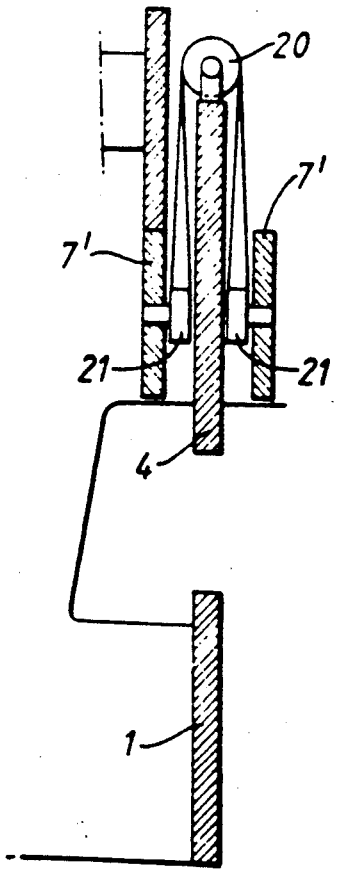
FIG. 4 shows a cross-section of FIG. 3.

FIGS. 3 and 4 illustrate an embodiment wherein a plurality of guide means formed by rolls 20 are provided on the up-and-down movable frame part 4 of the device supporting the upper beam, such rolls 20 being freely rotatable about their aligned central axes. The frame part 4 can thereby move up and down between a pair of plates 7, fixed to the stationary frame 1 of the device. To the plates 7, there are secured guide means formed by rolls 21, in such a manner that rolls 21 are freely rotatable about the axes of rotation perpendicularly crossing the axes of rotation of the rolls 20. The rolls 21 located on both sides of the up-and-down movable frame part 4 are slightly staggered with respect to each other, such that a roll 21 located on one side of frame part 4 is located between adjacent rolls 21 located on the other side of frame part 4 when seen in the longitudinal direction of the axes of rotation of the rolls 21.

Figure 2:
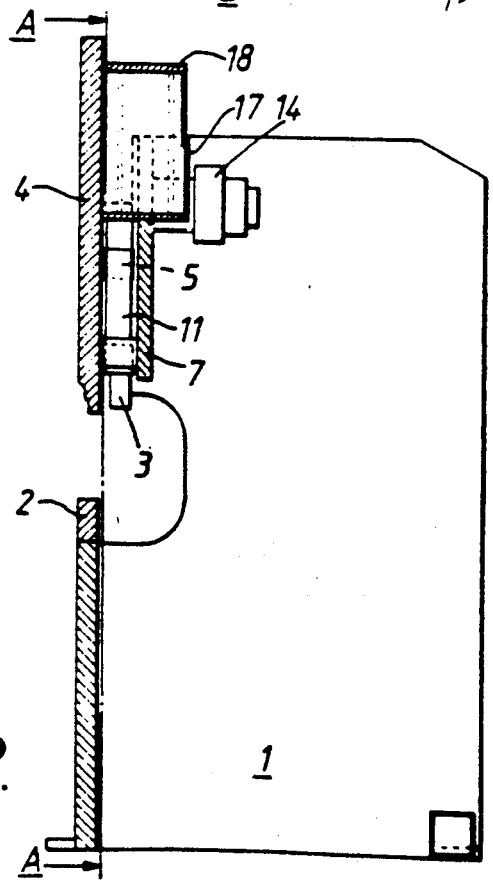
FIG. 2 shows a section of the device illustrated in FIG. 1, along the line B—B in FIG. 1.

As will be seen in particular from FIG. 3, it is possible with such an arrangement to arrange the various guide means formed by the rolls 20 and 21 which are connected with the stationary frame part 1 and with the movable frame part 4 closer to each other, along the longitudinal axis of frame part 4, than with the embodiment according to FIGS. 1 and 2. In this manner, an even more uniform axial distribution of the forces exerted over the frame parts in question will be obtained, by means of the flexible pulling means passed over the rolls, than with the application according to FIGS. 1 and 2.

What I claim:

1. Apparatus for working plate-like material, comprising:

a frame;

first and second cooperating elongated working means, said first working means mounted stationary relative to said frame, said second working means mounted for movement relative to said frame in a direction transverse to the longitudinal direction of said second working means and towards and away from said first working means;

a first plurality of guide means mounted on said second working means and aligned longitudinally along said second working means;

a second plurality of guide means mounted on said frame and aligned in the same longitudinal direction as said first plurality of guide means and disposed generally opposite said first plurality of guide means;

an elongated flexible pulling means passing over alternate ones of said first and second guide means;

means for fixing one end of said flexible pulling means relative to said frame; and driving means coupled to the other end of said flexible pulling means for selectively pulling and releasing said flexible pulling means longitudinally.

2. The apparatus as claimed in claim 1, wherein each of said guide means comprises a freely rotatable roller.

3. The apparatus as claimed in claim 2, wherein:

the axes of rotation of said first plurality of guide means are angularly disposed relative to the axes of rotation of said second plurality of guide means; and the axes of rotation of one of said first and second plurality of guide means are disposed substantially perpendicular to the longitudinal direction of said second working means.

4. The apparatus as claimed in claim 3, wherein the axes of the other of said first and second plurality of guide means are disposed in the longitudinal direction of said second working means and are coaxial.

5. The apparatus as claimed in claim 4, wherein:

said second working means comprises a vertically oriented plate-like member having an upper longitudinal edge and side faces;

said one plurality of guide means are disposed adjacent both side faces of said vertically oriented plate-like member; and said other plurality of guide means are arranged along and above said upper longitudinal edge of said vertically oriented plate-like member.

6. The apparatus as claimed in claim 4, comprising:

third and fourth pluralities of guide means having substantially the same construction and function as said first and second pluralities of guide means;

a second elongated flexible pulling means passing over alternate ones of said third and fourth guide means; and a second driving means coupled to said second flexible pulling means for selectively pulling and releasing said second flexible pulling means longitudinally in a direction opposite the direction said first-mentioned driving means pulls and release said first-mentioned flexible pulling means; and wherein:

said first and third guide means are arranged along a common line longitudinally of said second working means;

said second and fourth guide means are arranged along a common line longitudinally of said second working means; and said means for fixing includes means for fixing one end of said second flexible pulling means, relative to said frame, at a location between said first and second and said third and fourth pluralities of guide means.

7. The apparatus as claimed in claim 3, wherein:

said second working means comprises a vertically oriented plate-like member having an upper longitudinal edge and side faces;

said one plurality of guide means are disposed adjacent both side faces of said vertically oriented plate-like member; and said other plurality of guide means are arranged along and above said upper longitudinal edge of said vertically oriented plate-like member.

8. The apparatus as claimed in claim 7, comprising:

third and fourth pluralities of guide means having substantially the same construction and function as said first and second pluralities of guide means;

a second elongated flexible pulling means passing over alternate ones of said third and fourth guide means; and a second driving means coupled to said second flexible pulling means for selectively pulling and releasing said second flexible pulling means longitudinally in a direction opposite the direction said first-mentioned driving means pulls and releases said first-mentioned flexible pulling means; and wherein:

said first and third guide means are arranged along a common line longitudinally of said second working means;

said second and fourth guide means are arranged along a common line longitudinally of said second working means; and said means for fixing includes means of fixing one end of said second flexible pulling means, relative to said frame, at a location between said first and second and said third and fourth pluralities of guide means.

9. The apparatus as claimed in claim 3, comprising:

third and fourth pluralities of guide means having substantially the same construction and function as said first and second pluralities of guide means;

a second elongated flexible pulling means passing over alternate ones of said third and fourth guide means; and a second driving means coupled to said second flexible pulling means for selectively pulling and releasing said second flexible pulling means longitudinally in a direction opposite the direction said first-mentioned driving means pulls and releases said first-mentioned flexible pulling means; and wherein:

said first and third guide means are arranged along a common line longitudinally of said second working means;

said second and fourth guide means are arranged along a common line longitudinally of said second working means; and said means for fixing includes means for fixing one end of said second flexible pulling means, relative to said frame, at a location between said first and second and said third and fourth pluralities of guide means.

10. The apparatus as claimed in claim 1, comprising:

third and fourth pluralities of guide means having substantially the same construction and function as said first and second pluralities of guide means;

a second elongated flexible pulling means passing over alternate ones of said third and fourth guide means; and a second driving means coupled to said second flexible pulling means for selectively pulling and releasing said second flexible pulling means longitudinally in a direction opposite the direction said first-mentioned driving means pulls and releases said first-mentioned flexible pulling means; and wherein:

said first and third guide means are arranged along a common line longitudinally of said second working means;

said second and fourth guide means are arranged along a common line longitudinally of said second working means; and said means for fixing includes means for fixing one end of said second flexible pulling means, relative to said frame, at a location between said first and second and said third and fourth pluralities of guide means.

11. The apparatus as claimed in claim 10, wherein:

said frame comprises an elongated frame plate parallel to said second working means and on which are mounted said second plurality of guide means, said first and second driving means, and said means for fixing;

said means for fixing is located centrally of said frame plate; and said first and second driving means are mounted on opposite ends of said elongated frame plate.

12. The apparatus as claimed in claim 1, wherein said driving means comprises a brushless servo motor.

* * * * *